US006754913B2

(12) United States Patent
Haberkorn

(10) Patent No.: US 6,754,913 B2
(45) Date of Patent: Jun. 29, 2004

(54) SANITARY CLEANSING APPARATUS AND PROCESS

(76) Inventor: Wilhelm Andreas Haberkorn, 4 Painted Bunting La., Savannah, GA (US) 31411-3026

( * ) Notice: Subject to any disclaimer, the term of this patent is extended or adjusted under 35 U.S.C. 154(b) by 0 days.

(21) Appl. No.: 10/065,732

(22) Filed: Nov. 13, 2002

(65) Prior Publication Data

US 2003/0084506 A1 May 8, 2003

(51) Int. Cl.[7] ..... E03D 9/08
(52) U.S. Cl. ..... 4/420.4
(58) Field of Search ..... 4/420.2, 420.4

(56) References Cited

U.S. PATENT DOCUMENTS

| | | | | | |
|---|---|---|---|---|---|
| 4,451,942 | A | * | 6/1984 | Hirano et al. | 4/420.2 |
| 4,903,347 | A | * | 2/1990 | Garcia et al. | 4/420.4 |
| 5,390,277 | A | * | 2/1995 | Van Wagner et al. | 392/485 |
| 6,408,451 | B1 | * | 6/2002 | Carn et al. | 4/420.2 |
| 6,526,602 | B2 | * | 3/2003 | Jeon | 4/420.4 |

* cited by examiner

*Primary Examiner*—Charles E. Phillips

(57) ABSTRACT

A sanitary cleansing apparatus is provided for attachment to conventional toilets to facilitate posterior part cleansing with a cleaning fluid after use of the toilet. The "First Embodiment" utilizes a conventional toilet flush tank as its cleaning fluid source. A submergible housing, containing functional operating components and cleaning fluid, is inserted into the toilet flush tank. The submergible housing derives its cleaning fluid through a number of communicating fluid entry openings along its vertical axis while the functional operating components consist primarily of a cleaning fluid pump, a pressure release valve, and an electrical heater. A cleaning nozzle is mounted within the confines of a conventional toilet bowl. The cleaning nozzle creates a diffusing stream of cleaning fluid directed toward a projected cleaning area located within the confines of the toilet bowl. A disinfectant and deodorizing fluid is deposited onto the outer nozzle surfaces after every use to positively ensure sanitary conditions. The preferred range of the cleaning fluid flow is from 10 to 50 milliliters per second at a temperature range from 25° C. to 50° C. The cleaning fluid can consist of water only, water mixed with soap, water mixed with anti-bactericide, water mixed with anti-smelling agents and/or any combination thereof. The "Second Embodiment" utilizes an external cold water source and an external housing containing pump, heater and anti-siphon valve and sufficient free volume for cleaning fluid. Aside from the housing being external to a conventional toilet, this embodiment contains all the functionalities described in the first embodiment.

42 Claims, 3 Drawing Sheets

SANITARY CLEANSING APPARATUS AND PROCESS

BACKGROUND OF INVENTION

Complex patents: A number of relevant patents have been issued over the years that contain very complex and sophisticated mechanisms and control schemas; which results in a high cost of manufacture. Those patents result in commercial products that demand a premium price from consumers. Thus, its commercial market appeal is limited, particularly, within the US market. Historical low market penetrations substantiate the aforementioned statements. The applicable patents are:

Complex Patents

| Patent Number | Inventor | Patent Number | Inventor |
|---|---|---|---|
| 6,167,577 | Hammad | 4,704,748 | Takeda et al. |
| 6,105,178 | Kurisaki et al. | 4,628,548 | Kuosawa et al. |
| 5,953,766 | Szoke | 4,581,779 | Matsui et al. |
| 5,953,765 | Hayashi et al. | 4,553,274 | Yui |
| 5,898,956 | Kurisaki et al. | 4,551,868 | Kawai et al. |
| 5,884,345 | Sugiyama | 4,581,779 | Matsui et al. |
| 5,839,129 | Lee | 4,558,473 | Morikawa et al. |
| 5,826,282 | Matsumoto et al. | 4,553,274 | Yui |
| 5,765,238 | Furukawa et al. | 4,451,942 | Hirano et al. |
| 5,369,817 | Iguchi | 4,551,868 | Kawai et al. |
| 5,319,811 | Hauri | 4,550,454 | Yui |
| 5,279,001 | Vento | 4,406,025 | Huck et al. |
| 5,208,922 | Machinaga et al. | 4,393,525 | Kondo |
| 5,206,928 | Sporri | 4,391,004 | Kawai et al. |
| 5,203,037 | Kang | 4,389,738 | Ando et al. |
| 5,050,249 | Takeda et al. | 4,370,764 | Ando et al. |
| 4,987,617 | Furukawa et al. | 4,340,980 | Fushimi et al. |
| 4,980,933 | Tsutsui et al. | 4,304,016 | Oguma et al. |
| 4,841,582 | Matsui et al. | 3,995,326 | Umann |
| 4,829,606 | Hirashiba et al. | 3,430,267 | Van Houten |
| 4,807,311 | Ingels | 3,247,527 | Umann |
| 4,761,837 | Takeda | 2,875,450 | Umann |
| | | 2,872,687 | Maurer |

Simple mechanical patents: A number of relevant patents were issued over the years that fundamentally contain simple mechanisms and control schemas, which result in low cost of manufacture. Those patents result in commercial products that demand a low market price from consumers. Due to a variety of reasons, such commercial products, however, have failed to generate widespread market appeal and, market penetration within the US market. The applicable patents are:

Simple Mechanical Patents

| Patent Number | Inventor | Patent Number | Inventor |
|---|---|---|---|
| 6,339,852 | Huang | 4,242,764 | Fukuda |
| 6,192,527 | Paul | 4,181,985 | Rius |
| 6,178,568 | Boulieris | 4,127,904 | Junker |
| 6,105,179 | Burns | 4,094,018 | Bemthin |
| 5,987,660 | Wang | 4,068,325 | Bemthin |
| 5,933,881 | Smith | 4,014,355 | DiMatteo |
| 5,799,341 | Rodas | 3,914,804 | Schrader et al. |
| 5,754,988 | Presa | 3,810,260 | Lodl |
| 5,659,901 | Derakhsan | 3,570,015 | Rosengaus |
| 5,566,402 | Agha el-Rifai et al. | 3,513,487 | Palermo |
| 5,384,919 | Smith | 3,462,766 | Merkel Jr. |
| 5,359,736 | Olivier | 3,430,268 | Zoberg |
| 5,287,566 | Azada | 3,425,066 | Berger |

-continued

Simple Mechanical Patents

| Patent Number | Inventor | Patent Number | Inventor |
|---|---|---|---|
| 5,272,774 | Ivko et al. | 3,386,105 | Martini |
| 5,271,104 | LaTora | 3,044,076 | Martini |
| 5,263,205 | Leunissen | 3,015,826 | Aranas |
| 5,247,711 | Kwon | 2,852,782 | Sundberg |
| 5,210,885 | Ruo | 2,722,014 | Bonomolo |
| 5,142,711 | Parikh | 2,600,619 | Conterno |
| 5,138,726 | Campbell | 1,962,014 | Guidetti |
| 5,090,067 | Cogdill | 1,960,839 | Campus |
| 5,063,618 | Souka | 1,874,169 | Campus |
| 4,926,509 | Bass | 1,787,481 | Kellogg |
| 4,924,534 | Basile | 1,752,782 | Burton |
| 4,691,391 | Kuo | 1,521,892 | Koppin |
| 4,642,820 | Boring Jr. | 1,455,905 | Cook |
| 4,596,058 | Nourbaskhsh | 1,117,353 | Engel |
| 4,360,934 | Ishigami et al. | 613,616 | Adee |
| 4,334,329 | Miyanaga | | |

SUMMARY OF INVENTION

The present invention relates generally to toilets and, more specifically, to a toilet sanitary cleansing means whereby the user can wash the genitals and posterior parts of the body after use of the toilet.

A primary object of the present invention is to provide a toilet sanitary cleansing means that will overcome the shortcomings of prior art devices and processes.

A further object of the present invention is to provide a sanitary cleansing processes and a sanitary cleansing means that includes a defined projected cleaning area, a defined cleaning fluid, a defined cleaning fluid rate and a defined cleaning fluid temperature.

A further object of the present invention is to provide a toilet sanitary cleansing means which is able to wash at least one of the genitals and posterior portions of a user's body A further object of the present invention is to provide a toilet sanitary cleansing means that can be easily adapted to virtually all commercially available toilets, in particular, toilets with water supply tanks, toilets with pressurized cold water flush systems, and toilets with access to both cold and water sources.

A further object of the present invention is to provide a toilet-sanitary cleansing means that can be used to clean posterior parts of the body after toilet use without the use of toilet paper, which is a functionality of particular importance for boat toilets and other toilets operating in environmentally sensitive areas where sanitary system cannot handle the processing of toilet paper.

A further object of the present invention is to provide a toilet sanitary cleansing means that has a self cleaning, disinfecting and deodorizing function for the nozzle itself.

A further object of the present invention is to provide a toilet sanitary cleansing means that can be economically manufactured and is reliable in its operation.

A further objective of the present invention is to provide the means of maintaining completely clean and sanitary conditions for all users at all times.

Another object of the present invention is to provide a toilet sanitary cleansing means that is simple and easy to use.

Upon further study of the specification and appended claims, other objects, features and advantages of the present invention will become more fully apparent to those skilled in the art to which this invention pertains.

DETAILED DESCRIPTION

Figure 1:
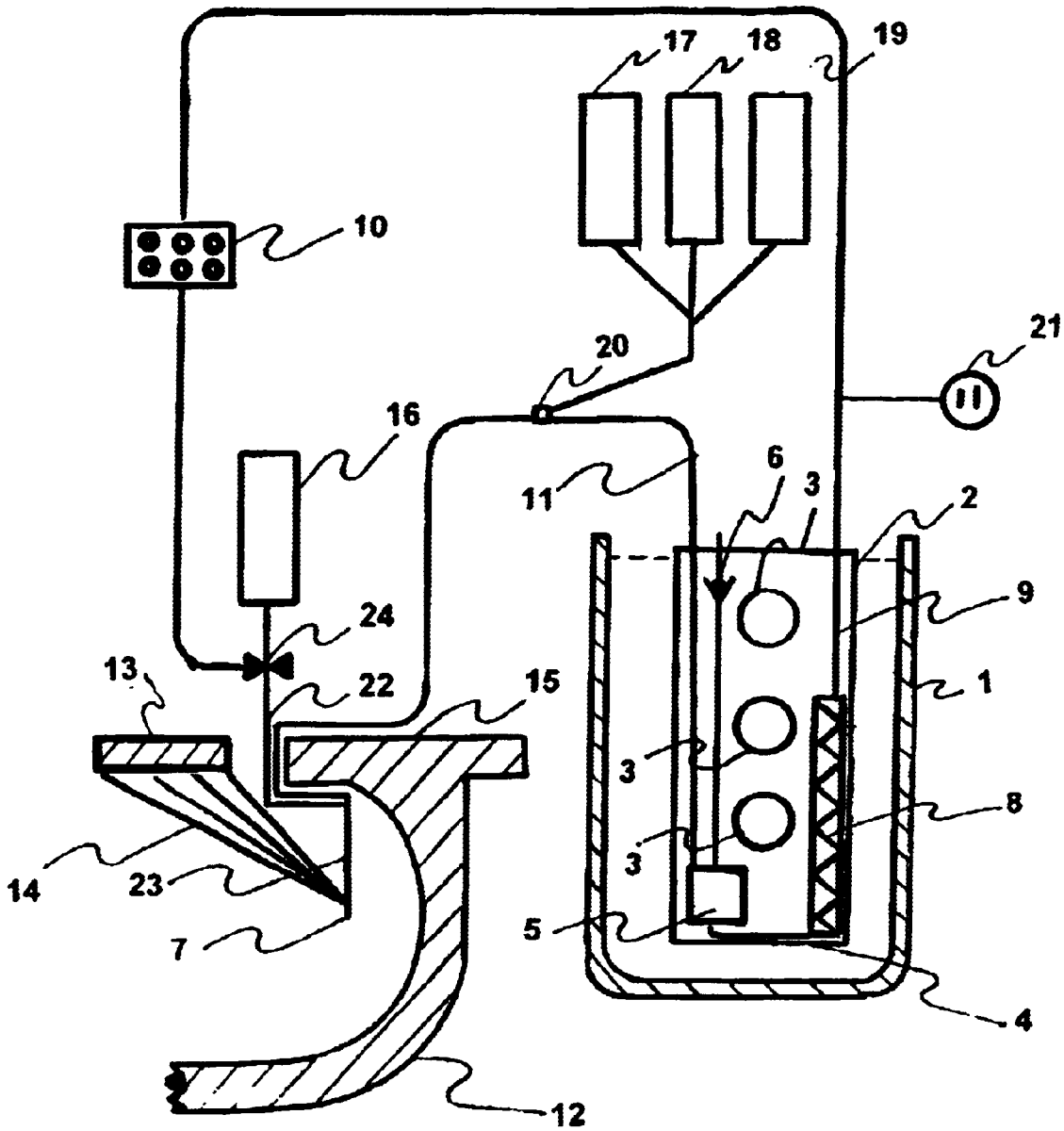
FIG. 1 is a schematic view of the components depicting one preferred embodiment of this invention.
Figure 2:
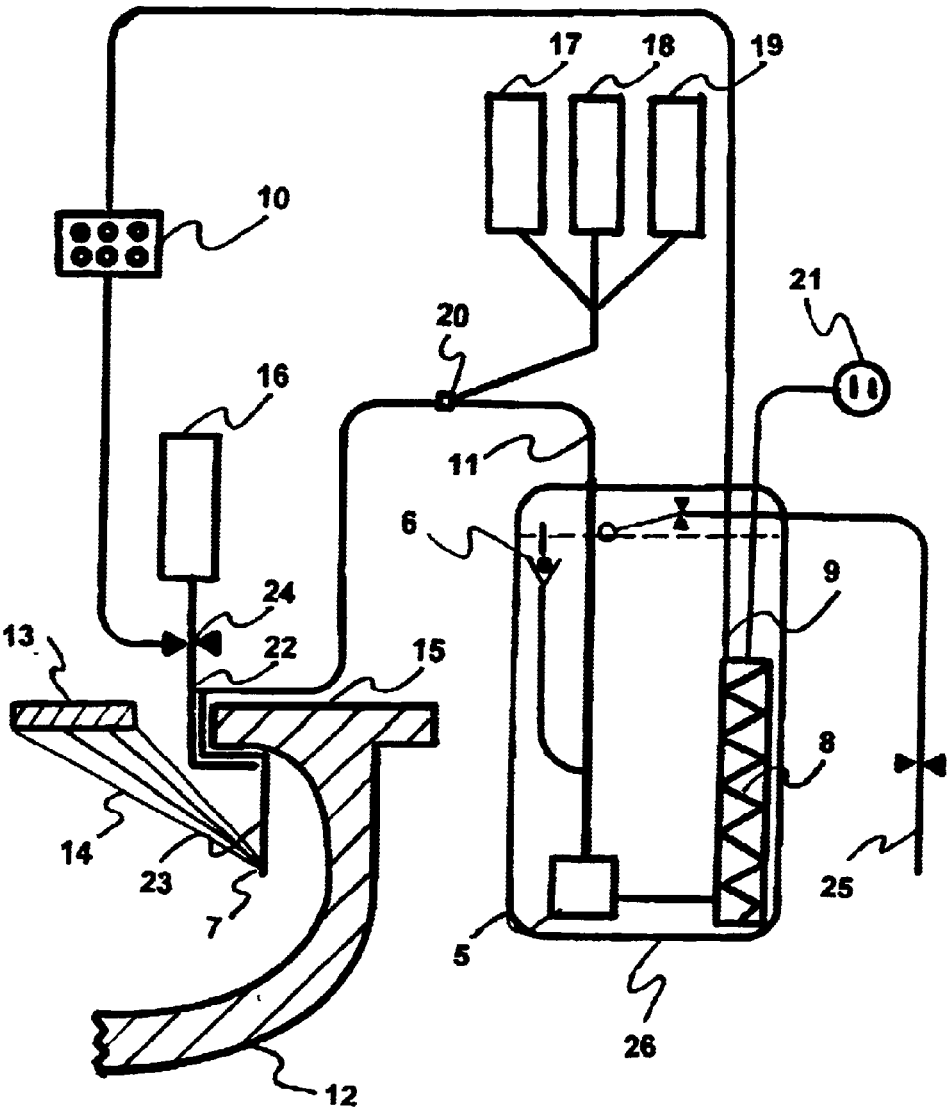
FIG. 2 is another schematic view of the components depicting another preferred embodiment of this invention.
Figure 3:
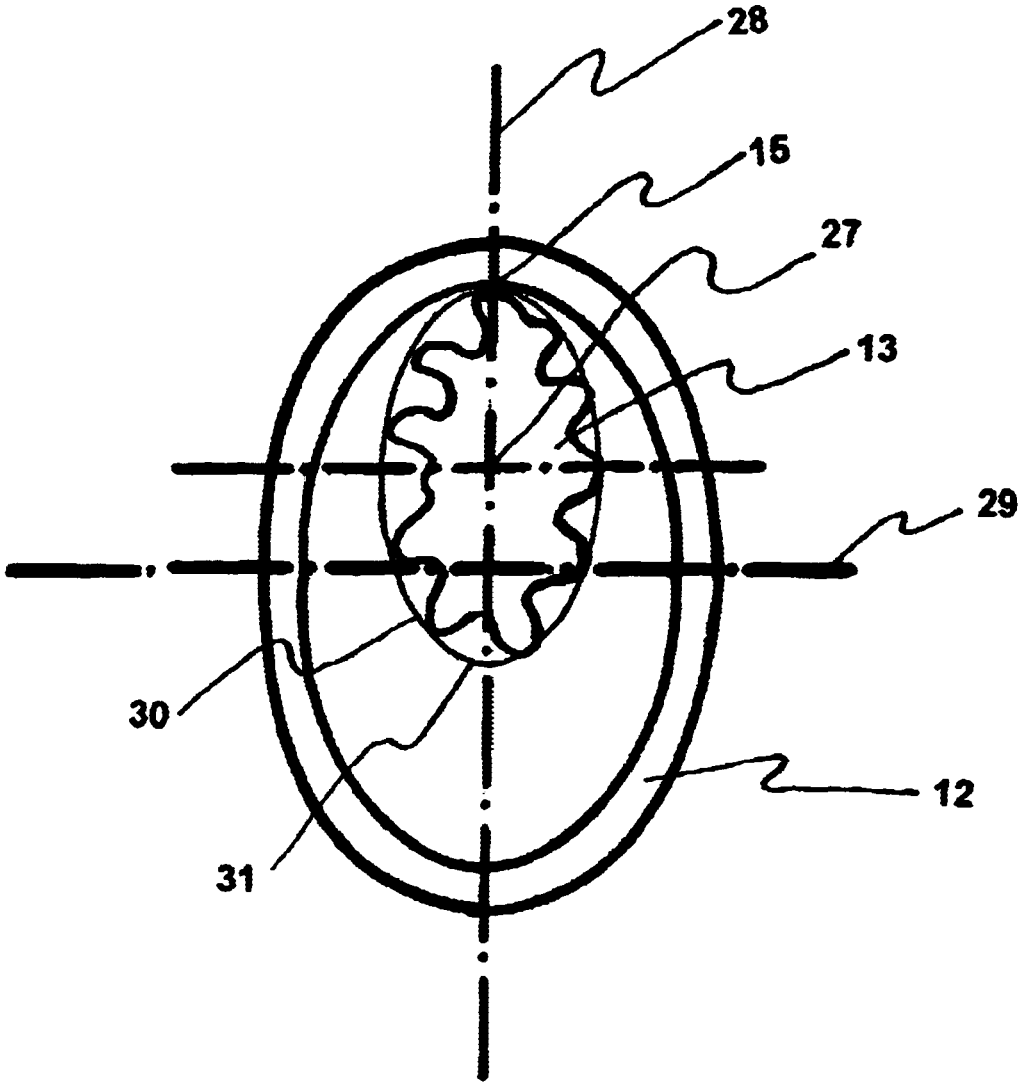
FIG. 3 is a top down view of a toilet bowl depicting the concept of a projected cleaning area in accordance with this invention.

This invention overcomes numerous disadvantages and problems found within the prior art. The prior art can be classified into complex and simple devices. While such complex devices are typically very expensive to manufacture and such simple devices are relatively inexpensive to manufacture, there is a general lack of market acceptance for any of those devices which indicates additional problems. None of those devices require a set of process conditions within which to operate them. None require a projected cleaning area 13 within which cleaning of the genitals and posterior parts of the body can take place. None of the devices can be economically installed into all types of toilets, including flush tank and pressurized flush type toilets. None provide a device that operates with a cleaning fluid composed of multiple ingredients other than water. None provide an environmentally friendly paperless toilet for use on boat toilets and other toilets operating in environmentally sensitive areas where sanitary system cannot handle the processing of toilet paper. None define a sanitary cleaning process for the device itself, whereby commercially available disinfectant and deodorizer fluids 16 are an integral part of the cleaning process. The detailed description of the preferred embodiments will address the aforementioned limitations and describe the solutions provided by the invention.

One preferred embodiment utilizes a conventional toilet flush tank 1 as the cleaning water source, thus avoiding any water piping modification all together. A submergible housing 2 is inserted into the toilet flush tank 1. Said housing has sufficient volume to accommodate both, the functional operating components and the cleaning fluid. Said submergible housing 2 derives its cleaning fluid through a number of communicating fluid entry openings 3 along its vertical axis. A residual cleaning fluid level is maintained at all times by having said communicating fluid entry openings 3 start at a minimum volume level of one (1) liter from its base. Said submergible housing 2 has a solid base 4, can vary in geometric shape to accommodate various toilet models and can be either open or closed at its top.

Said functional operating components located inside said submergible housing 2 consist of the following: A cleaning fluid pump 5 connected to a cleaning fluid pressure release valve 6, a means to pipe 11 said cleaning fluid to an externally located cleaning nozzle 7, and an electrical heater 8 that heats said cleaning fluid to a temperature ranging from 25° C. to 50° C. Also residing inside said submergible housing 2 is an electrical power 21 and a control wire connection 9 to said cleaning fluid pump 5 to and said electrical heater 8. A pressure sensitive switch installed under the toilet seat is used to prevent pump activation without the weight of a person sitting on the toilet. Said cleaning fluid pump 5 operates at a cleaning fluid pumping rate of 10 to 50 milliliters per second.

The operating duration of said cleaning fluid pump 5 is a) controlled by the user by means of an on/off switch 10 or b) set within the apparatus. The fluid rate is set by means of a mechanical or electrical controller within the said rate boundaries, either set by the user during the use or set as a constant within the pump itself. The cleaning fluid temperature is set at the heater by controlling the rate of electrical power consumption or cleaning fluid temperature using either open loop or closed loop controllers.

A fluid pressure release valve 6, residing within the submergible housing 2, evacuates the cleaning fluid resident within the section from cleaning fluid pump 5 to cleaning nozzle 7 while providing three important functions. First, such valve interrupts the siphoning flow of the cleaning fluid after deactivating the cleaning fluid pump 5. Second, such valve provides a low level cleaning function for the contaminated cleaning nozzle 7. Third, such valve prevents cold cleaning fluid from being present at the beginning of next cleaning cycle.

A means, which pipes 11 cleaning fluid from the cleaning fluid pump 5 to a cleaning nozzle 7 mounted within the confines of a conventional toilet bowl 12, accommodates the cleaning fluid flow rates and cleaning fluid pressures and routes the cleaning fluid to the point of use, the cleaning nozzle 7. Said means to pipe 11 cleaning fluid is particularly configured for ease of installation and reliable operation.

Said cleaning nozzle 7 is mounted within the confines of a conventional toilet bowl 12 along its longitudinal axis at the back end of the toilet bowl 12 and below the rim of said toilet bowl 12. Said cleaning nozzle 7 is positioned within a well defined area defined by horizontal tolerance ranging from 30 to 150 millimeters below the rim of said toilet bowl 12 and vertical tolerance bound by plus/minus 80 millimeters from said longitudinal center line. Said cleaning nozzle 7 is mounted within 0 to 50 millimeters of the inner wall at the back end below the rim of said toilet bowl 12. Said nozzle is positioned in an upward angle that is defined by a projected cleaning area 13 and bound by an area created by the inside rim of said toilet bowl 12.

Said cleaning nozzle 7 creates a single diffused stream 14 of cleaning fluid directed toward said projected cleaning area 13 located within the confines of said toilet bowl 12; where, said projected cleaning area 13 is parallel to the area projected by the inside corner of the upper rim 15 of said toilet bowl 12, and said projected cleaning area 13 is centered in the rear half 27 of the toilet bowl 12 along the longitudinal center line 28 and segmented by the latitudinal center line 29 of the toilet bowl 12. Said projected cleaning area 13 is singular in any geometric shape 30 fitting within the confines of an oval 31, centered in the rear half along the longitudinal axis of any conventional toilet bowl 12, wherein said oval is bound in the rear end of the toilet bowl 12 by the toilet bowl 12 rim. The maximum width of said boundary projected cleaning area 13 oval is 150 millimeters while its maximum length is 200 millimeters.

Another variation of the said cleaning nozzle 7 is a specific cleaning cycle for the cleaning nozzle 7 itself. This cycle is achieved by piping and depositing a disinfectant and deodorizer 16 onto the outer nozzle's surfaces 23 after every use to ensure sanitary conditions for the subsequent user. This cleaning process is achieved through the use of a parallel piping conduit 22 that terminates at the upper end of the nozzle mount in a manner that assures complete coverage of the outer nozzle's surfaces 23. The cleaning agent is located at the originating end of said conduit. A control circuit 24 automatically dispenses said cleaning agent after the nozzle is disengaged by the user. Readily commercially available toilet cleaning agents, such as DOW disinfectant bathroom cleaner, can be used as a cleaning agent for this purpose. The combination of a self-cleaning nozzle 7 and a disinfectant and deodorizer 16 will assure complete sanitary operation for every user.

Another embodiment of said cleaning nozzle 7 is one that creates a plurality of diffusing streams of cleaning fluid toward said projected cleaning area 13 of the various preferred geometric shapes.

A key feature of this invention is the definition of a set of process conditions for the various apparatuses. It is deemed very important to have said cleaning fluid expelled by said cleaning nozzle 7 at a specific flow rate and specific temperature. The preferred range of said cleaning fluid flow is from 10 to 50 milliliters per second at a temperature range from 25° C. to 50° C. The specific set point of both parameters are selected and set by the user according to personal preference. The apparatus has the capability of controlling both the flow rate and the temperature within reasonable tolerance limits.

Said cleaning fluid can consist of water only, water mixed with soap 17, water mixed with anti-bactericide 18, water mixed with anti-smelling agents 19 and any combination thereof. Those additives are added via injectors 20 in liquid form or slowly released into the cleaning water in solid form, or any other known method of adding water soluble components to said cleaning fluid.

The second preferred embodiment is one that uses an external cold water supply 25 and an external housing 26 containing a pump 5, a heater 8, an anti-siphon value 6, an electrical power source 21, a control wiring 21, and sufficient free volume to hold cleaning fluid. Aside from the housing being external to a conventional toilet 12, this embodiment contains all the functionality described in the above detail description of the first embodiment of this invention. It is different from the first embodiment in that it does not require a said communicating fluid entry opening 3 within its housing, however, does require insulation 26 around its body to minimize power use. The said external housing 26 can be either foot mounted or wall mounted to fit the special requirements of its users. The external housing 26 embodiment is particularly well suited for high frequency use installations; the cleaning fluid storage volume and its internal components, such as the cleaning fluid pump 5 and the cleaning fluid heater, can be sized to fit virtually all needs from extremely high usage at public facilities to low usage private use facilities. The routing of cleaning fluid from the external housing 26 to the toilet bowl 12, its installation, the location of its cleaning nozzle 7, and its use are identical to the description provided for the first embodiment. This device can be installed into a boat in an environmentally friendly manner.

While the present invention is described with reference to the preferred embodiments, it is in no way the intention to limit the invention to those embodiments but rather to include all modification, alterations and equivalent possible arrangements within the scope of the appended claims.

What is claimed is:

1. A posterior part cleansing apparatus consisting of the following components:

a. A submergible housing;

b. Said housing having a plurality of communicating fluid entry openings along its vertical axis;

c. Said housing containing the following components:

i. A cleaning fluid pump, ii. A pressure release valve that interrupts the cleaning fluid flow after deactivation of said fluid pump, iii. A cleaning fluid heater, and iv. A power source that provides power to both said heater and pump;

d. A means to control duration of pump activation;

e. A cleaning nozzle mounted within the confines of any conventional toilet;

f. A means to pipe the cleaning fluid into the cleaning nozzle;

g. Said cleaning nozzle creates a defused stream of cleaning fluid to a specific projected cleaning space located within the confines of the toilet bowl where, i. Said projected cleaning space upper area is parallel to the area projected by the upper rim of the toilet bowl, ii. Said projected cleaning space is centered in the rear half of the toilet bowl along the longitudinal center line and segmented by the latitudinal center line of the toilet bowl, iii. Said projected cleaning space upper area is planar in any geometric shape, fitting within the confines of an oval area centered in the rear half along the longitudinal axis of any conventional toilet bowl, where said oval area has a maximum width of 150 millimeters and a maximum length of 200 millimeters, and said oval area is bound in the rear end of said toilet bowl by the inner rim of said toilet bowl, and iv. Said projected cleaning space as a height protruding into the toilet bowl of up to 100 millimeters.

2. An apparatus specified in claim 1, where the cleaning nozzle creates a plurality of streams of cleaning fluid toward the projected cleaning space.

3. An apparatus specified in claim 1, where the submergible housing has a base area ranging from 50 to 130 square centimeters and a volume ranging from 800 to 5,000 cubic centimeters.

4. An apparatus specified in claim 2, where the submergible housing has a base area ranging from 50 to 130 square centimeters and a volume ranging from 800 to 5,000 cubic centimeters.

5. An apparatus specified in claim 1, where the submergible housing has a solid base and a solid top area.

6. An apparatus specified in claim 2, where the submergible housing has a solid base and a solid top area.

7. An apparatus specified in claim 1, where the submergible housing has a solid base and an open top area.

8. An apparatus specified in claim 2, where the submergible housing has a solid base and an open top area.

9. An apparatus specified in claim 1, where said communicating fluid entry holes start a volume of one liter from the base.

10. An apparatus specified in claim 2, where said communicating fluid entry holes start a volume of one liter from the base.

11. An apparatus specified in claim 1, where a. Said cleaning nozzle is mounted along the longitudinal axis at the back end of any conventional toilet bowl with a vertical tolerance from the center line of plus or minus 80 millimeters, and b. Said cleaning nozzle is positioned below the upper edge of the rim of said toilet bowl within the toilet bowl in a horizontal tolerance range from 30 to 150 millimeters and within 0 to 175 millimeters of the inner wall of said toilet bowl.

12. An apparatus specified in claim 2, where a. Said cleaning nozzle is mounted along the longitudinal axis at the back end of any conventional toilet bowl with a vertical tolerance from the center line of plus or minus 80 millimeters, and b. Said cleaning nozzle is positioned below the upper edge of the rim of said toilet bowl within the toilet bowl in a horizontal tolerance range from 30 to 150 millimeters and within 0 to 175 millimeters of the inner wall of said toilet bowl.

13. An apparatus specified in claim 1, where a pressure sensitive switch is located under the lid of any conventional toilet bowl.

14. An apparatus specified in claim 2, where a pressure sensitive switch is located under the lid of any conventional toilet bowl.

15. An apparatus specified in claim 1, where the cleaning nozzle has a sanitary cleaning cycle after every use wherein a disinfectant and deodorizer is deposited onto the exposed nozzle surfaces.

16. An apparatus specified in claim 2, where the cleaning nozzle has a sanitary cleaning cycle after every use wherein a disinfectant and deodorizer is deposited onto the exposed nozzle surfaces.

17. A process employing apparatus specified in claim 1, where the cleaning fluid is provided to the projected cleaning space at a rate ranging from 10 to 50 milliliters per second and at a temperature ranging from 25 to 50 degree centigrade.

18. A process employing apparatus specified in claim 2, where the cleaning fluid is provided to the projected cleaning space at a rate ranging from 10 to 50 milliliters per second and at a temperature ranging from 25 to 50 degree centigrade.

19. A process employing apparatus specified in claim 1, where the cleaning fluid is provided to the projected cleaning space at a rate ranging from 10 to 50 milliliters per second, at a temperature ranging from 25 to 50 degree centigrade, and at a nozzle exit velocity ranging from 4 to 6 meters per second.

20. A process employing apparatus specified in claim 2, where the cleaning fluid is provided to the projected cleaning space at a rate ranging from 10 to 50 milliliters per second, at a temperature ranging from 25 to 50 degree centigrade, and at a nozzle exit velocity ranging from 4 to 6 meters per second.

21. A process employing apparatus specified in claim 1, where cleaning fluid is provided to the projected cleaning space at a rate ranging from 10 to 50 milliliters per second at and a temperature ranging from 25 to 50 degree centigrade, and a disinfectant and deodorizer is deposited onto the exposed nozzle surfaces for a time period ranging from 0.5 to 10 seconds at the end of every cleaning cycle.

22. A process employing apparatus specified in claim 2, where cleaning fluid is provided to the projected cleaning space at a rate ranging from 10 to 50 milliliters per second and at a temperature ranging from 25 to 50 degree centigrade, and a disinfectant and deodorizer is deposited onto the exposed nozzle surfaces for a time period ranging from 0.5 to 10 seconds at the end of every cleaning cycle.

23. A process employing apparatus specified in claim 1, where the cleaning fluid is water.

24. A process employing apparatus specified in claim 2, where the cleaning fluid is water.

25. A process employing apparatus specified in claim 1, where the cleaning fluid is a mixture of soap and water.

26. A process employing apparatus specified in claim 2, where the cleaning fluid is a mixture of soap and water.

27. A process employing apparatus specified in claim 1, where the cleaning fluid is a mixture of water, anti-bactericides and soap.

28. A process employing apparatus specified in claim 2, where the cleaning fluid is a mixture of water, anti-bactericides and soap.

29. A process employing apparatus specified in claim 1, where the cleaning fluid is a mixture of water, anti-bactericides, anti-smelling agents and soap.

30. A process employing apparatus specified in claim 2, where the cleaning fluid is a mixture of water, anti-bactericides anti-smelling agents and soap.

31. A process employing apparatus specified in claim 1, where the duration of the cleaning cycle is automatically time controlled.

32. A process employing apparatus specified in claim 2, where the duration of the cleaning cycle is automatically time controlled.

33. A process employing apparatus specified in claim 1, where the duration of the cleaning cycle to manually time controlled.

34. A process employing apparatus specified in claim 2, where the duration of the cleaning cycles to manually time controlled.

35. A process employing apparatus specified in claim 1, where the rate of cleaning fluid is user controllable within a range of 10 to 50 milliliters per second.

36. A process employing apparatus specified in claim 2, where the rate of cleaning fluid is user controllable within a range of 10 to 50 milliliters per second.

37. A process employing apparatus specified in claim 1, where the temperature of the cleaning fluid is user controllable within a range of 15 to 50 degrees centigrade.

38. A process employing apparatus specified in claim 2, where the temperature of the cleaning fluid is user controllable within a range of 15 to 50 degrees centigrade.

39. A process employing apparatus specified in claim 1, where the rate of cleaning fluid is controllable within a range of 10 to 50 milliliters per second, and where the temperature of the cleaning fluid is controllable within a range of 30 to 50 degrees centigrade.

40. A process employing apparatus specified in claim 2, where the rate of cleaning fluid is controllable within a range of 10 to 50 milliliters per second, and where the temperature of the cleaning fluid is controllable within a range of 30 to 50 degrees centigrade.

41. A process employing apparatus specified in claim 1, where the rate of cleaning fluid is controllable within a range of 10 to 50 milliliters per second, the temperature of the cleaning fluid is controllable within a range of 30 to 50 degrees centigrade, and a disinfectant and deodorizer is deposited onto the exposed nozzle surfaces for a period ranging from 0.5 to 10 seconds at the end of every cleaning cycle.

42. A process employing apparatus specified in claim 2, where the rate of cleaning fluid is controllable within a range of 10 to 50 milliliters per second, the temperature of the cleaning fluid is controllable within a range of 30 to 50 degrees centigrade, and a disinfectant and deodorizer is deposited onto the exposed nozzle surfaces for a period ranging from 0.5 to 10 seconds at the end of every cleaning cycle.

* * * * *